-/10/86 4,593,865

United States Patent [19]

Honegger

[11] Patent Number: 4,593,865

[45] Date of Patent: Jun. 10, 1986

[54] WINDING MANDREL FOR A COIL OR WOUND PACKAGE FORMED OF FLEXIBLE, SUBSTANTIALLY FLAT PRODUCTS, ESPECIALLY PRINTED PRODUCTS

[75] Inventor: Werner Honegger, Tann-Rüti, Switzerland

[73] Assignee: Ferag AG, Hinwil, Switzerland

[21] Appl. No.: 649,371

[22] Filed: Sep. 11, 1984

[30] Foreign Application Priority Data

Sep. 19, 1983 [CH] Switzerland ..... 5068/83

[51] Int. Cl.[4] ..... B65H 18/04

[52] U.S. Cl. ..... 242/67.1 R; 242/55; 242/68

[58] Field of Search ..... 242/55, 56.9, 66, 67.1 R, 242/68.3, 77, 68, 54 R, 117

[56] References Cited

U.S. PATENT DOCUMENTS

| | | | |
|---|---|---|---|
| 1,992,077 | 2/1935 | La Rock | 242/68 |
| 2,846,159 | 8/1958 | Reynolds | 242/67.1 R |
| 2,889,123 | 6/1959 | Hayden | 242/68.3 |
| 2,913,276 | 11/1959 | Collings | 414/684 X |
| 2,998,206 | 8/1961 | Pendleton | 242/68.3 X |
| 3,844,503 | 10/1974 | Peterson | 242/67.1 R |

FOREIGN PATENT DOCUMENTS 2398171 2/1979 France .

*Primary Examiner*—Donald Watkins
*Attorney, Agent, or Firm*—Werner W. Kleeman

[57] ABSTRACT

The winding mandrel comprises a cylindrical winding drum or body which has two circumferential web members on its inner side. Each web member lies substantially in a plane which lies outside the center of gravity of the winding mandrel together with the coil or wound package. The winding mandrel bears upon two driven and tandemly arranged support wheels with one of its web members. A support roll is arranged beneath these support wheels. A lateral support surface of the web member bears against this support roll. The support wheels are constructed as friction drive wheels and, in addition to supporting the winding mandrel, serve to drive the winding mandrel. Due to the overturning or tipping moment induced by the eccentricity of the bearing points of the winding mandrel upon the support wheels in relation to the center of gravity, the winding mandrel is pressed against the support roll. This has the effect that the winding mandrel maintains the desired position during its rotation. This position is partly determined by the support roll constituting a contact roll arranged to be immovable in the direction of the longitudinal axis of the winding mandrel.

30 Claims, 9 Drawing Figures

WINDING MANDREL FOR A COIL OR WOUND PACKAGE FORMED OF FLEXIBLE, SUBSTANTIALLY FLAT PRODUCTS, ESPECIALLY PRINTED PRODUCTS

CROSS REFERENCE TO RELATED APPLICATION

This application is related to the commonly assigned, co-pending U.S. patent application Ser. No. 06/732,585, filed May 10, 1985 and entitled "PRINTED PRODUCT COIL".

BACKGROUND OF THE INVENTION

The present invention broadly relates to winding stations for substantially flat products and, more specifically, pertains to a new and improved construction of a winding mandrel for a coil or wound package formed from flexible, substantially flat products, especially printed products, as well as to an apparatus for supporting such a winding mandrel.

Generally speaking, the winding mandrel of the present invention comprises a hollow cylindrical winding drum.

It is known to wind up the printed products output by a rotary printing press or rotogravure machine in imbricated product formation upon a winding mandrel (cf. for instance Swiss Pat. No. 559,691, granted Jan. 31, 1975, and German Patent Publication No. 3,123,888 corresponding to the U.S. Pat. No. 4,438,618, issued Mar. 27, 1984, as well as German Patent Publication No. 3,236,866 corresponding to the commonly assigned, copending U.S. patent application Ser. No. 06/432,557, filed Oct. 4, 1982). The completed printed product coils or wound packages are then stored in an intermediate storage depot in order to be withdrawn therefrom at a suitable later time and transported to a processing station. The printed products are then removed from the storage coil or wound package at this processing station by unwinding.

In the solution known from the previously mentioned German Patent Publication No. 3,236,866, corresponding to the aforementioned copending U.S. patent application Ser. No. 06/432,557, the winding mandrel is journalled in a mobile frame or stand and remains connected therewith. This facilitates both the transport of the winding mandrel together with the coil or wound package and the coupling and wound package and the coupling and uncoupling of the winding mandrel to the winding and unwinding station. However, this requires a considerable investment since a great number of such construction-intensive mobile frames are required in service, which also remain occupied for a more or less long time interval in the intermediate storage depot. Furthermore, the storage of both the empty frames and the frames carrying a printed product storage coil or wound package require a relatively great amount of space.

The winding mandrel known from the Swiss Patent No. 559,691 previously mentioned comprises a hollow cylindrical winding drum which must be mounted on a drive shaft for winding and unwinding the printed products and whose diameter corresponds to the inside diameter of the winding drum. Mounting the winding drum on and unmounting the winding drum from the drive shaft is inconvenient and also requires a certain amount of care. Furthermore, the winding mandrel must be precisely made in order to have a good seat on the drive shaft.

In order to facilitate transport, the winding drum of this known winding mandrel is provided with end flanges or cheek plates which are constructed as bearing or running flanges. Due to these lateral cheek plates, the efficiency of exploitation of storage space for the empty winding mandrels is, however, unsatisfactory. Furthermore, the fabrication of such winding mandrels is relatively complicated.

SUMMARY OF THE INVENTION

Therefore, with the foregoing in mind, it is a primary object of the present invention to provide a new and improved construction of a winding mandrel of the previously mentioned type which does not exhibit the aforementioned drawbacks and shortcomings of the prior art constructions.

Another and more specific object of the present invention aims at providing a new and improved construction of a winding mandrel of the previously mentioned type which is economical to fabricate, of simple and compact design, requires little storage space, is easy to manipulate and can be coupled to devices of simple and trouble-free design for winding and unwinding.

Yet a further significant object of the present invention aims at providing a new and improved construction of a winding mandrel of the character described and an apparatus for supporting the same which are each relatively simple in construction and design, highly reliable in operation, not readily subject to breakdown and malfunction and require a minimum of maintenance and servicing.

Now in order to implement these and still further objects of the invention, which will become more readily apparent as the description proceeds, the winding mandrel of the present invention is manifested by the features that it possesses a hollow cylindrical winding drum which has an interior, a longitudinal axis and an associated plane extending essentially perpendicular to the longitudinal axis and lying outside the center of gravity. The winding drum includes at least one support member for axial support and at least one support element for radial support. The support element extends along the interior of the winding drum and is arranged in the therewith associated plane. Advantageously, the support member and the support element may be constituted by the same part or component.

The apparatus for supporting the winding mandrel of the present invention is manifested by the features that it comprises support means for cooperating with the support element of the winding drum and a support structure for cooperating with the support member of the winding drum.

If the winding mandrel is deposited upon a support means of a winding and unwinding unit or station upon a support element of the winding mandrel, which is preferably formed by a circumferential web protruding inwardly from the winding drum or by an annular groove open toward the interior of the winding drum, then the disposition of the support element outside the center of gravity of the empty winding mandrel or of the winding mandrel loaded with a storage coil or wound package causes an overturning or tipping moment to act upon the winding mandrel. This overturning or tipping moment tends to bring the winding mandrel, respectively the storage coil or wound package, into a tilted position. However, the support member bearing against an abutment of the winding or unwinding unit or station prevents the winding mandrel from assuming such a tilted position. The winding mandrel is, however, due to this tipping moment, pressed against the abutment oriented toward the support structure with a certain force. This force ensures that the winding mandrel, and therefore also the storage coil or wound package, remains in the proper orientation during winding and unwinding, i.e. in a substantially vertical orientation. This pressure of the support member of the winding drum against the abutment can be exploited during unwinding for braking the winding mandrel. This renders the provision of a special braking device superfluous.

The manipulation of the winding mandrel, respectively of the storage coil or wound package formed thereupon, and especially its coupling to and uncoupling from the winding and unwinding unit or station is very simple. The winding mandrel need only be deposited upon the support means and brought to bear against the abutment. This manipulation is made even simpler when two support elements arranged in mutual spaced relationship are provided. In such a preferred embodiment, any suitable transport device, e.g. a fork-lift truck, can engage one support element of the winding mandrel and deposit the winding mandrel upon the support means at the other support element of the winding mandrel.

Preferably at least one of the support elements of the winding mandrel is constructed as part of a friction or gear drive means, whose other part is formed by friction or drive wheels of the support means. In this manner the coupling of the winding mandrel to its drive can occur simultaneously with deposition upon the support means.

In a particularly simple design embodiment and as already mentioned, the support member and the support element are formed by the same component or part of the winding mandrel, e.g. by a web or an annular groove.

The winding mandrel according to the invention is simple in construction and can be fabricated economically and without great effort. Storage of both the empty winding mandrels and the winding mandrels carrying storage coils or wound packages requires a minimum of space.

The apparatus for supporting a winding mandrel according to the invention is adapted in design to the winding mandrel and comprises, in addition to support means cooperating with the winding drum, the support structure cooperating with the support member of the winding drum. The simple construction of the winding drum therefore permits the support apparatus to also be of simple design.

In a preferred embodiment, the support means comprises two rotatably journalled support wheels which lie opposite one another, i.e. in tandem in relation to a vertical plane substantially coincident with the axis of rotation of the winding mandrel and whose axes extend substantially parallel to this vertical plane. In this manner, a perfect support of the winding mandrel is obtained with simple means.

In order to be able to drive the winding mandrel resting upon the support means during the winding procedure in simple manner, it is advantageous to drive the support wheels and to construct them either as friction drive wheels or as gears.

The braking of the winding drum supported on the support means during the unwinding procedure is advantageously effected in that the support structure is provided with a brake lining or pad upon which a braking surface of the support member bears.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
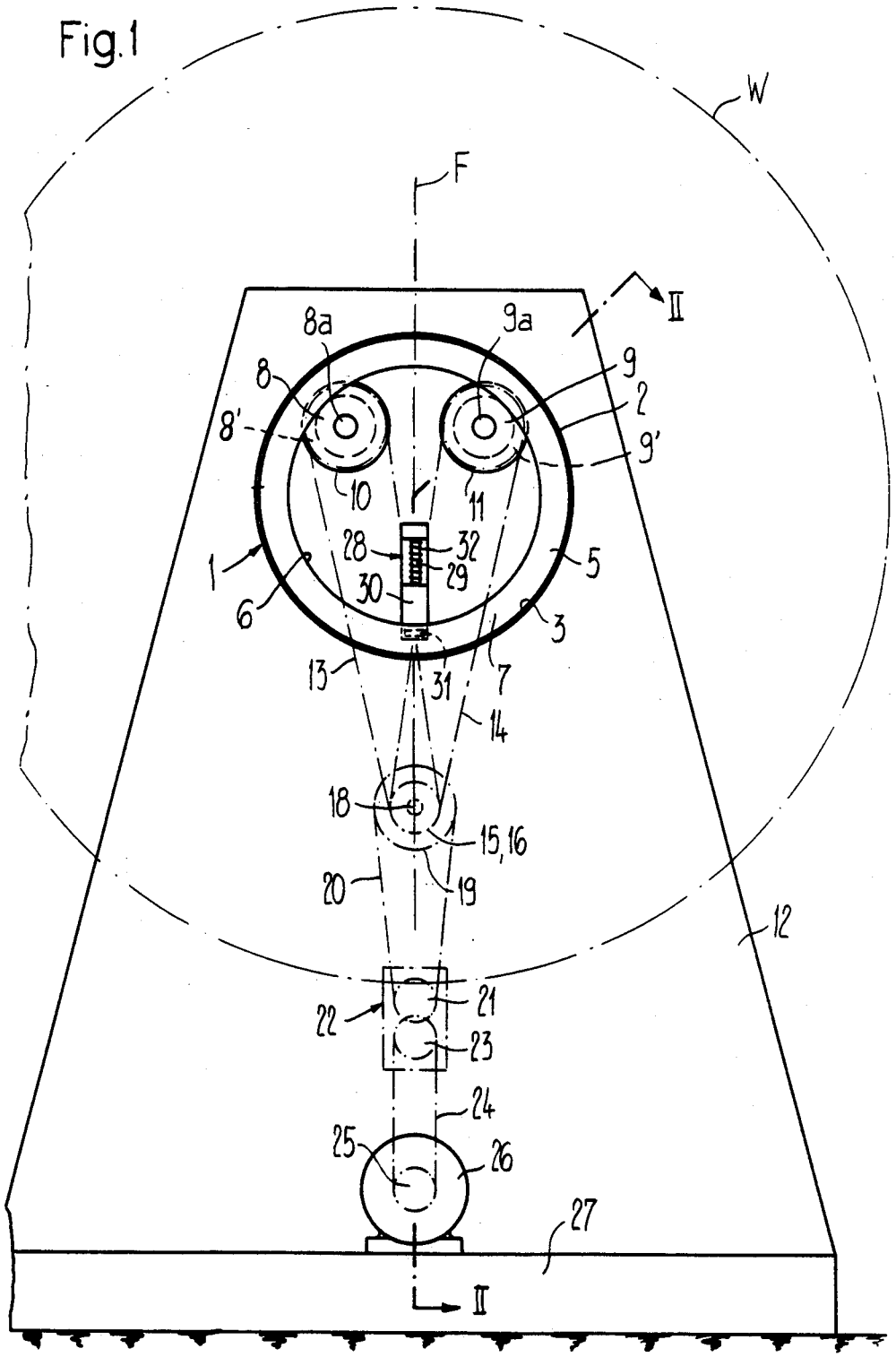
FIG. 1 schematically illustrates in frontal elevation a first embodiment of a winding station.

Describing now the drawings, it is to be understood that to simplify the showing thereof only enough of the structure of the winding mandrel and of the apparatus for supporting the winding mandrel has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise a winding mandrel 1 having the same construction as all of the winding mandrels illustrated in the FIGS. 1 through 4, 5 and 6 and comprises a hollow cylindrical winding drum or body 2 open on both end faces. Two mutually spaced circumferential webs or flanges 4 and 5 are arranged on the interior 3 of the winding drum 2 and protrude in radial direction from the interior 3 of the winding drum 2.

These webs 4 and 5 lie in planes E, respectively E', which extend essentially perpendicular to the longitudinal axis *2a* of the winding drum 2 and at a distance from the center of gravity S of the winding mandrel 1. Each web 4 and 5 is provided with a bearing surface 6 as well as a lateral support surface 7 which lies upon the side of the web 4 or 5 more remote from the other web 5 or 4, respectively.

This winding mandrel 1 serves to support or carry a storage coil or wound package W, which consists of a plurality of coil layers formed in known manner from printed products. A winding band or strap is wound in between the individual coil layers as is described in more detail in the previously mentioned German Patent Publication No. 3,123,888 and the corresponding British Patent Publication No. 2,081,230, both corresponding to the aforementioned U.S. patent application Ser. No. 06/432,557.

Figure 2:
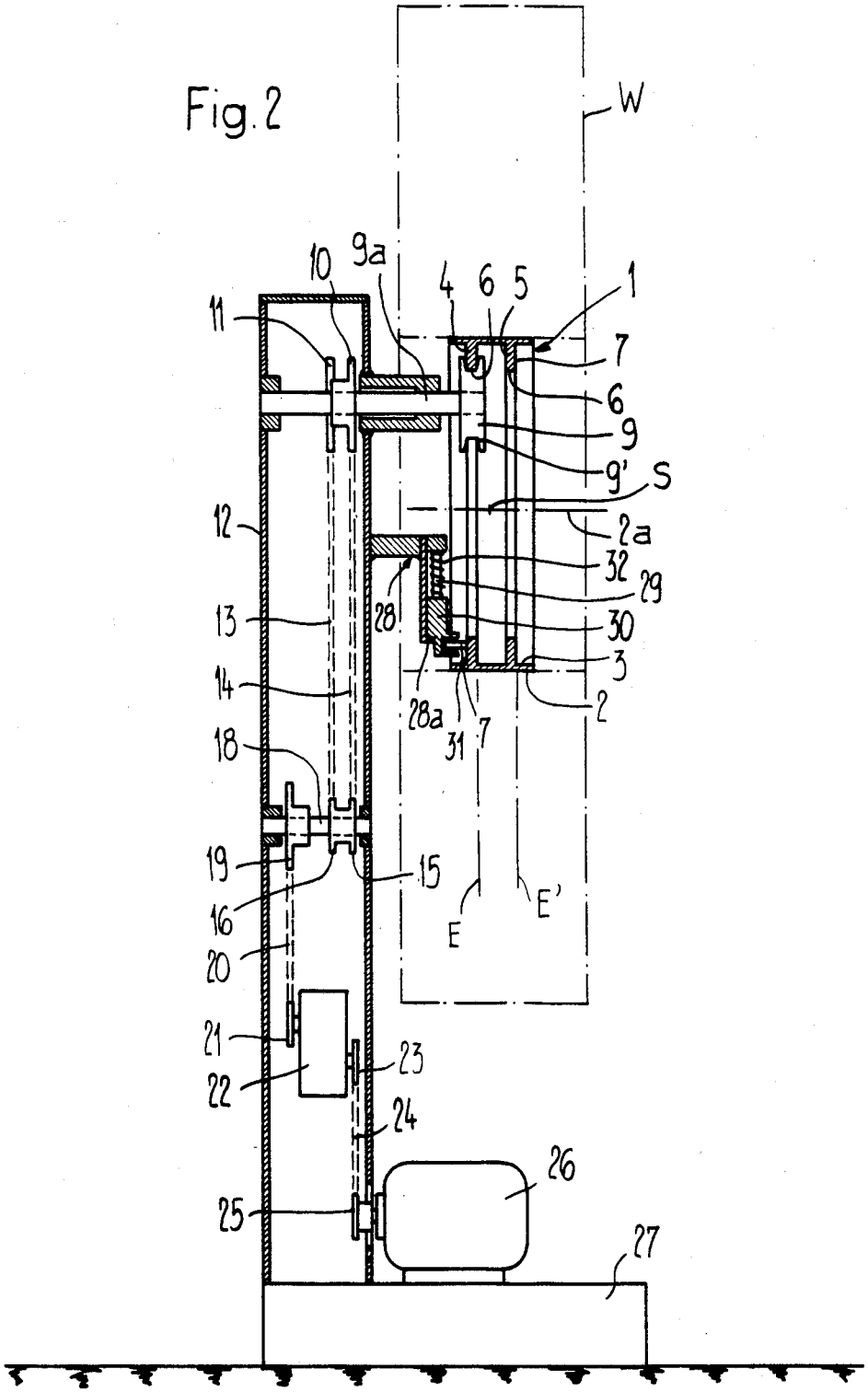
FIG. 2 schematically illustrates a section taken along the line II—II in FIG. 1.

A first embodiment of a winding station is shown in FIGS. 1 and 2 in which the winding mandrel 1 is driven in order to wind up the printed products upon the winding mandrel 1. For this purpose, the winding mandrel 1 bears upon two support wheels 8 and 9 with its web 4. The support wheels 8 and 9 therefore form a support means for the winding mandrel 1. Both support wheels 8 and 9 lie opposite one another in relation to a vertical plane F (cf. FIG. 1) essentially coincident with the longitudinal axis 2*a* of the winding mandrel 1 and are seated on shafts 8*a* and 9*a* whose axes extend substantially parallel to this vertical plane F.

As can be particularly well seen in FIG. 2, the support wheels 8 and 9 comprise peripheral or circumferential grooves 8' and 9', respectively, in which the web 4 engages. The web 4 bears with its bearing surface 6 upon the bottoms or bases of these peripheral grooves 8' and 9'. Both support wheels 8 and 9 are constructed as friction drive wheels, which means that there is tractive contact at least between the bearing surfaces 6 of the web 4 and the support wheels 8 and 9. By appropriate adaptation of the width of the peripheral grooves 8' and 9' to the thickness of the web 4, tractive contact can also be obtained between the lateral surfaces of the web 4 and the side walls of the peripheral grooves 8' and 9'.

Figure 8:
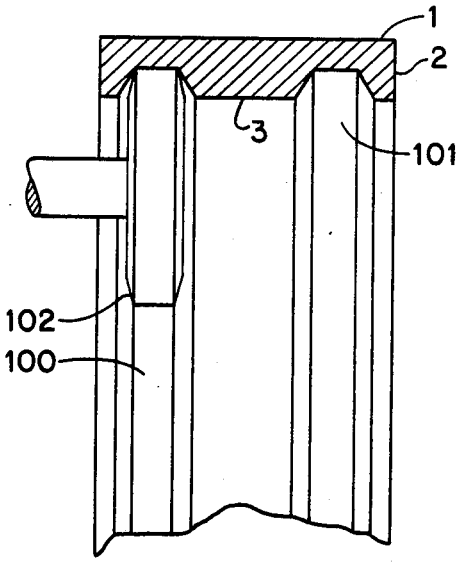
FIG. 8 schematically illustrates a section analogous to that of FIG. 2 but taken through an alternate embodiment of the invention.

It will be appreciated that the webs 4 and 5 may be replaced by conceptually equivalent peripheral grooves formed at the interior 3 of the winding drum 2 for engaging essentially flat cylindrical support wheels conceptually equivalent to the peripherally grooved support wheels 8 and 9. FIG. 8 illustrates a suitable embodiment of such grooves 100 and 101 engaging a support wheel 102.

Chain wheels or sprockets 10 and 11 are also seated upon the drive shafts 8*a* and 9*a* of the support wheels 8 and 9, respectively. Each sprocket 10 and 11 is arranged in the interior of a housing 12 upon which suitable bearings for the drive shafts 8*a* and 9*a* are also mounted. Each of the sprockets 10 and 11 is in driving relation with a further sprocket 15 and 16 by means of a drive chain 13 and 14, respectively. The two sprockets 15 and 16 form a unit and are seated upon a shaft 18 rotatably journalled in the housing 12, which also carries a further sprocket 19.

A drive chain 20 runs over the sprocket 19 and also engages a sprocket 21 mounted on the power take-off shaft of a winding gearing 22. This winding gearing 22 is of known type, such as is commercially available from Antrieb Werner Reimers KG. The drive shaft of this winding gearing 22 carries a further sprocket 23 which is connected with a sprocket 25 by means of a drive chain 24. The sprocket 25 is seated on the shaft of a drive motor 26. The latter is mounted upon a base or foot 27 which also supports the housing 12.

A mounting bracket or holder 28 is also mounted upon the housing 12, in which a pin 29 is held in a vertical direction. This pin 29 penetrates a support component 30 for a support roll 31 which is translatable along the pin 29 guided by the mounting bracket 28. The support component 30 is pressed downward by a compression spring 32 against an abutment or stop 28*a* provided on the mounting bracket 28. The winding mandrel 1 bears with the web 4 against the support roll 31 supported on the mounting bracket 28. The winding mandrel 1 bears with the outer side face of the web 4 which is constructed as a support surface 7. The winding mandrel 1 is therefore supported both in the radial direction by the support wheels 8 and 9 and in the axial direction by the support roll 31 through the web 4.

As will be evident from the preceding description, in order to from a storage coil or wound package W upon the winding mandrel 1, the winding mandrel 1 is set in rotation by the friction drive wheels 8 and 9 which are driven by the drive motor 26. The winding up of the printed products together with a suitable known type of winding band or strap not particularly shown in FIGS. 1 and 2, is performed basically in the manner described in the previously mentioned German Patent Publication No. 3,123,888 and the corresponding British Patent Publication No. 2,081,230, both corresponding to the aforementioned U.S. patent application Ser. No. 06/432,557.

Since, as previously mentioned, the web 4, and therefore the bearing point of the winding mandrel 1 upon the support wheels 8 and 9, lies outside the plane of the center of gravity S of the empty as well as of the loaded winding mandrel 1, a moment acts to press the winding mandrel 1, respectively its web 4, against the support roll 31 which is stationary relative to the rotatable winding mandrel 1. This moment is due to the dead weight of the winding mandrel 1 and the storage coil or wound package W upon the winding mandrel 1. This ensures that the winding mandrel 1 always bears upon the support roll 31 during its rotation and therefore always assumes the proper, i.e. vertical orientation during the unwinding procedure. This orientation is ultimately determined by the support roll 31. Therefore no further guide means are required beyond the support or drive wheels 8 and 9 and the support roll 31 in order to hold the rotating winding mandrel 1 in its proper orientation.

After completion of the storage coil or wound package W, the winding mandrel 1, together with the storage coil or wound package W, can be uncoupled in simple manner. This can be performed by means of a suitable transport device, e.g. a fork-lift truck, which engages the exposed web 5, raises the winding mandrel 1, together with the storage coil or wound package W, until the web 4 disengages from the peripheral grooves 8' and 9' of the support wheels 8 and 9 and then transports the winding mandrel 1, together with the storage coil or wound package W, away, e.g. to an intermediate storage depot.

During this raising of the winding mandrel 1, the support component 30 together with the support roll 31 is entrained by the winding drum 2 and moved upward against the action of the compression spring 32. After the winding mandrel 1 has been removed, the support component 30 and the support roll 31 are moved downwardly again against the abutment or stop 28*a* by the compression spring 32. This translatability of the support component 30 and the support roll 31 prevents the printed products in the storage coil or wound package W from being damaged by the support roll 31 during removal of the winding mandrel 1.

The coupling of a new, empty winding mandrel 1 is effected in analogous manner. The winding mandrel 1 engaged by the transport device at the web 5 is deposited with the other web 4 upon the support wheels 8 and 9, whereupon the winding mandrel 1 bears against the support roll 31 due to the overturning or tipping moment arising for the reasons previously mentioned. The coupling of any such winding mandrel 1 to the winding station can therefore be performed with simple means and very quickly, just as can the uncoupling of the full winding mandrel 1.

Figure 9:
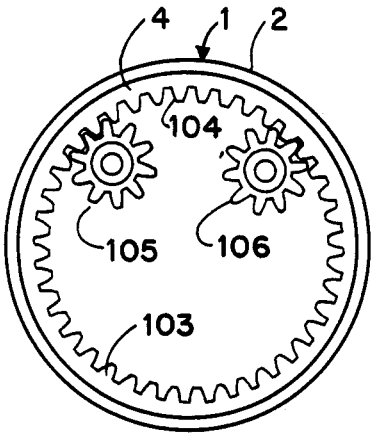
FIG. 9 schematically illustrates in partial frontal view a further embodiment of the invention.

Instead of setting the winding mandrel 1 in rotation by means of a friction drive as described above, the winding mandrel 1 can also be driven by a gear transmission. In this case it would be necessary to construct the support wheels 8 and 9 as gears and to provide the webs 4 and 5 with gear teeth in meshing engagement with the gears defining the support wheels 8 and 9. FIG. 9 illustrates a suitable embodiment of such gear teeth 104 formed in the web 4 and engaging tandemly arranged gears or gear wheels 105 and 106. The web 4 thus constitutes an internally toothed ring gear 103.

Figure 3:
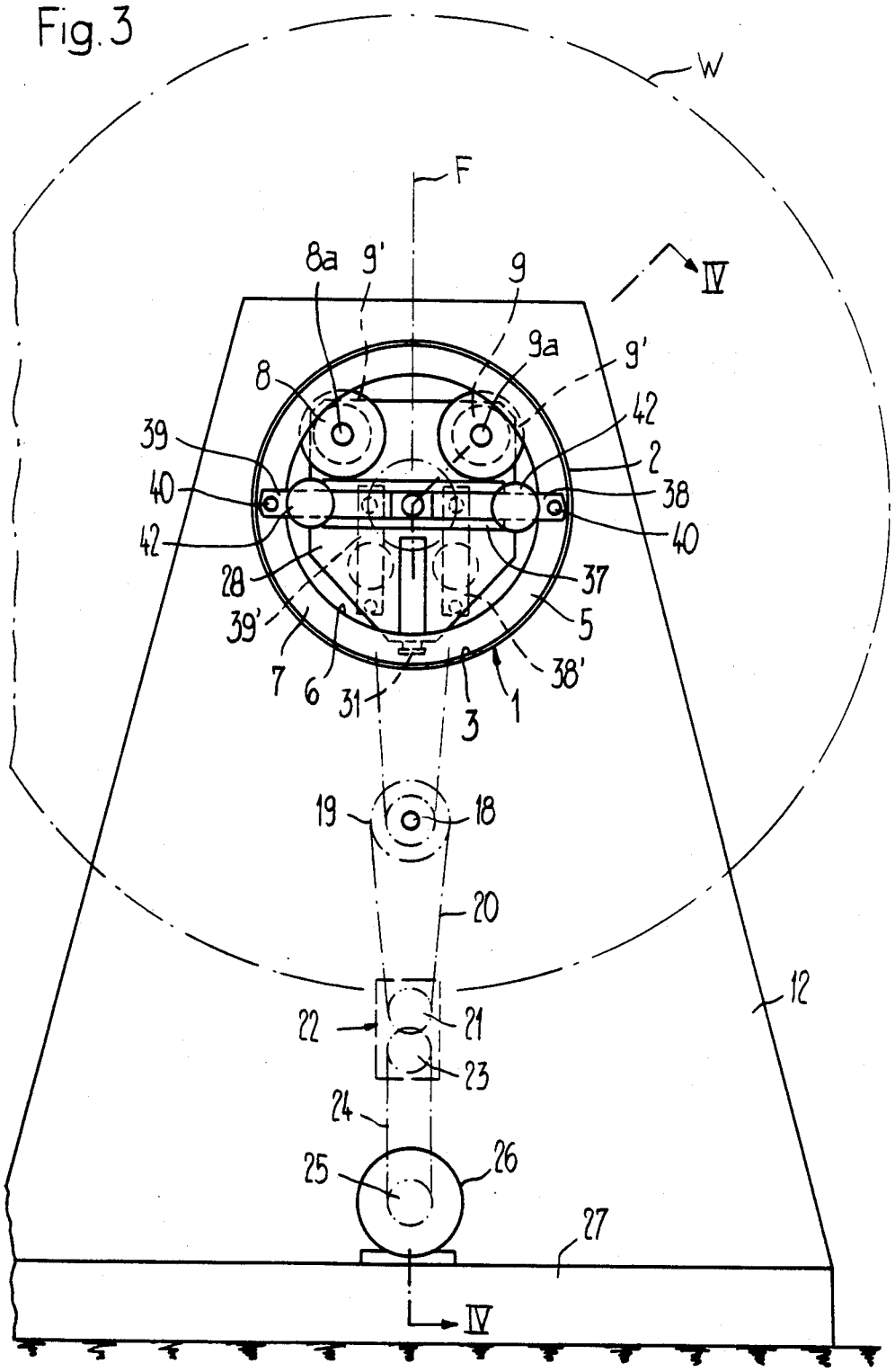
FIG. 3 schematically illustrates in frontal elevation a second embodiment of a winding station.
Figure 4:
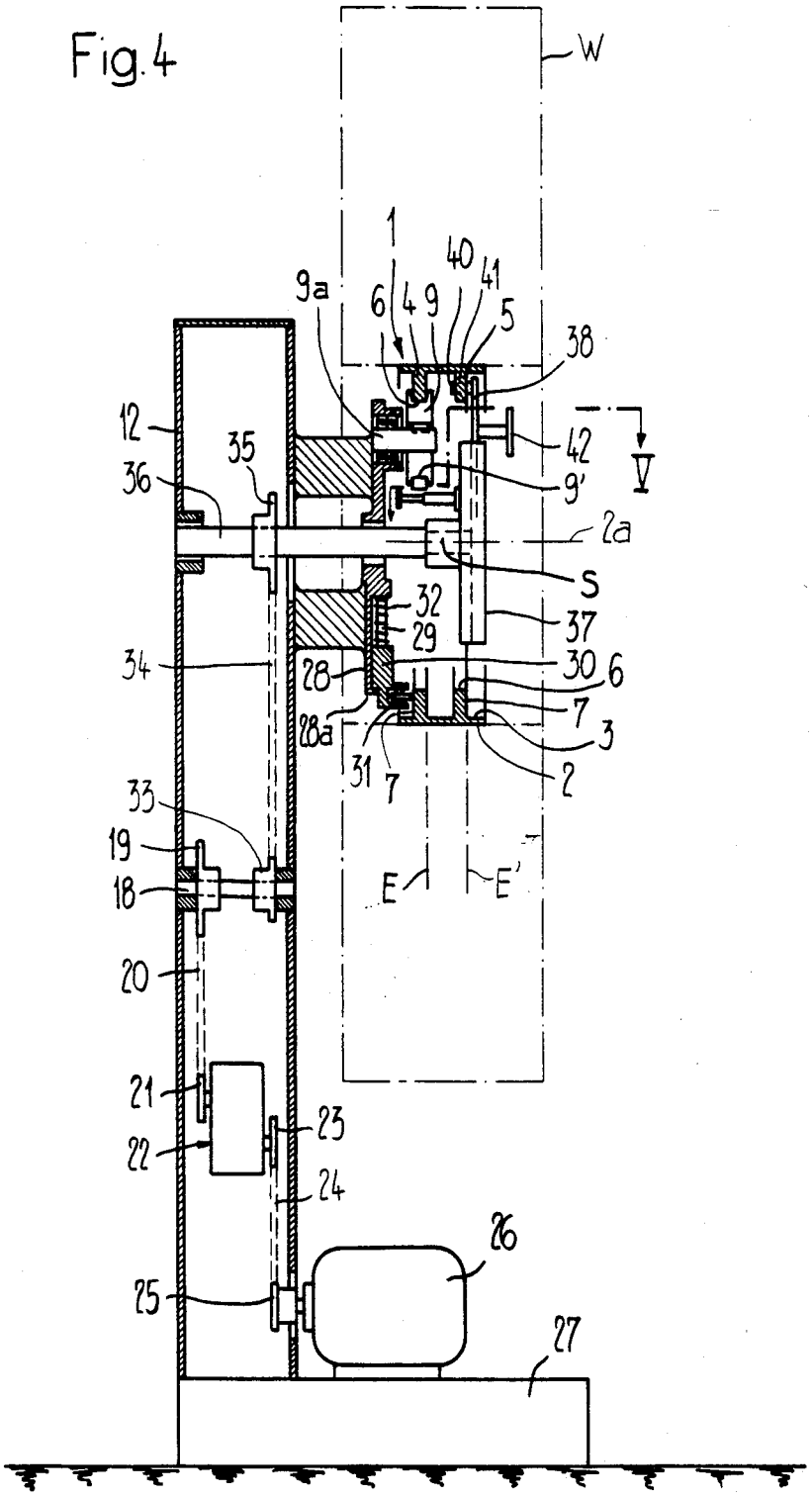
FIG. 4 schematically illustrates a section taken along the line IV—IV in FIG. 3.
Figure 5:
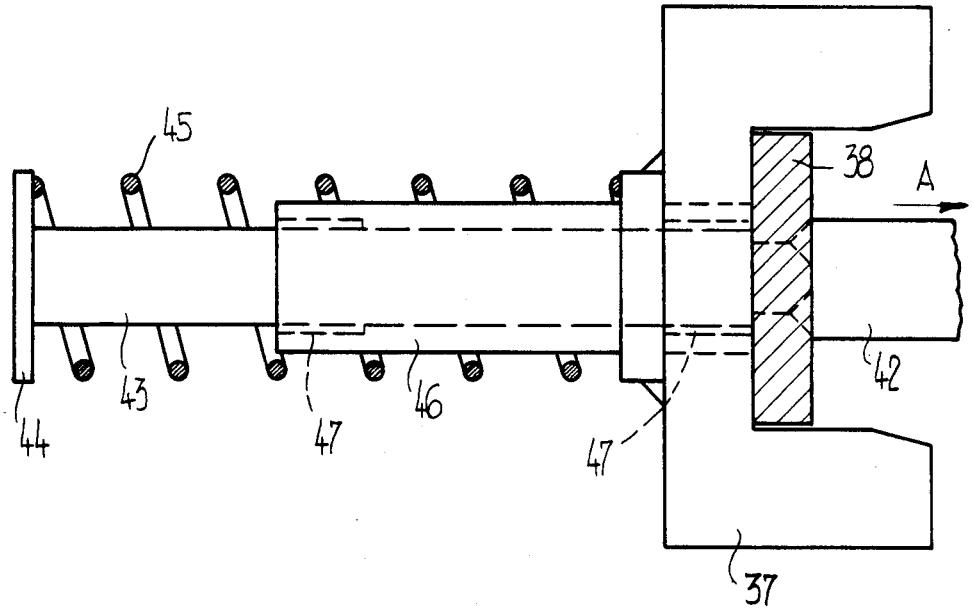
FIG. 5 schematically illustrates a section taken along the line V—V in FIG. 4 and on an enlarged scale in relation to such FIG. 4.

A further embodiment of a winding unit or station is illustrated in the FIGS. 3 through 5 which differs from the embodiment according to FIGS. 1 and 2 in the means of driving the winding mandrel 1. The same or analogous components in both embodiments are generally provided with the same reference characters in these FIGS. 3 and 5 as in the FIGS. 1 and 2. In the following only those characteristics of the second embodiment which distinguish it from the first embodiment according to FIGS. 1 and 2 will be described in more detail.

In the second embodiment according to FIGS. 3 through 5, both support wheels 8 and 9 are no longer driven but are freely rotatably journalled in the mounting bracket 28 which, in relation to FIGS. 1 and 2, is constructed differently and somewhat larger. A single sprocket 33 is seated upon the shaft 18 instead of the two sprockets 15 and 16 and is in driving relation with a sprocket 35 by means of a drive chain 34. The sprocket 35 is seated on a shaft 36 which penetrates the mounting bracket 28. The shaft 36 is journalled in the mounting bracket 28 as well as in a bearing mounted on the housing 12.

The shaft 36 carries an entrainment element 37 at its free end which has a channel or U-shaped cross-section, as can best be seen in FIG. 5. Two drive levers 38 and 39 are arranged in the space defined by the flanges of the entrainment element 37. The drive levers 38 and 39 protrude laterally beyond the entrainment element 37, as can be seen from FIGS. 3 and 4.

These drive levers 38 and 39 each carry an entrainment pin 40 at their free ends which penetrates a through hole 41 in the outer web 5 (cf. FIG. 4). Each drive lever 38 and 39 is furthermore provided with a hand grip 42 and furthermore carries a protruding pin 43. The pin 43 penetrates the web of the entrainment element 37 and is provided at its free end with an annular shoulder 44 (cf. FIG. 5). A compression spring 45 is arranged between this annular shoulder 44 and the entrainment element 37. The pin 43 is translatably guided in axial direction by means of a guide member 46 having a sliding bushing 47 and mounted on the entrainment element 37. It will be apparent from the preceding description that, due to the coupling of the winding mandrel 1 with the entrainment element 37 by the drive levers 38 and 39 and the entrainment pin 40, the winding mandrel is set in rotation when the entrainment element 37 is driven.

In order to be able to remove the winding mandrel 1 in the manner described in relation to FIGS. 1 and 2 after completion of the storage coil or wound package W, the entrainment connection must first be disengaged. For this purpose the drive levers 38 and 39 are moved in the direction of the arrow A (cf. FIG. 5) by pulling on the hand grip 42 and are withdrawn into the interior of the entrainment element 37 by compressing the compression spring 45. During this motion, the entrainment pins 40 also retract from the through holes 41 in the web 5. The drive levers 38 and 39 are then pivoted downward into the position designated with the reference characters 38′ and 39′ and shown in dotted line in FIG. 3, in which they do not interfere with the lifting of the winding mandrel 1, together with the storage coil or wound package W, from the support wheels 8 and 9.

After depositing an empty winding mandrel 1, the drive levers 38 and 39 are again moved into their operative position in which the entrainment pins 40 engage in the through holes 41 in the web 5.

Relative to FIGS. 1 and 2, the solution shown in FIGS. 3 through 5 provides greater assurance of trouble-free drive of the winding mandrel 1 at the desired speed and also provides a slip-free transmission of torque. It is, however, coupled with the disadvantage of greater construction outlay and the necessity of manual operation in coupling and uncoupling.

It will be understood that a drive for the winding mandrel 1 separate from the support wheels 8 and 9 can also be constructed other than as is shown in FIGS. 3 and 4. In such alternate embodiments, it will nevertheless be advantageous to provide a disengageable entrainment connection between the drive means and one of the webs 4 or 5.

Figure 6:
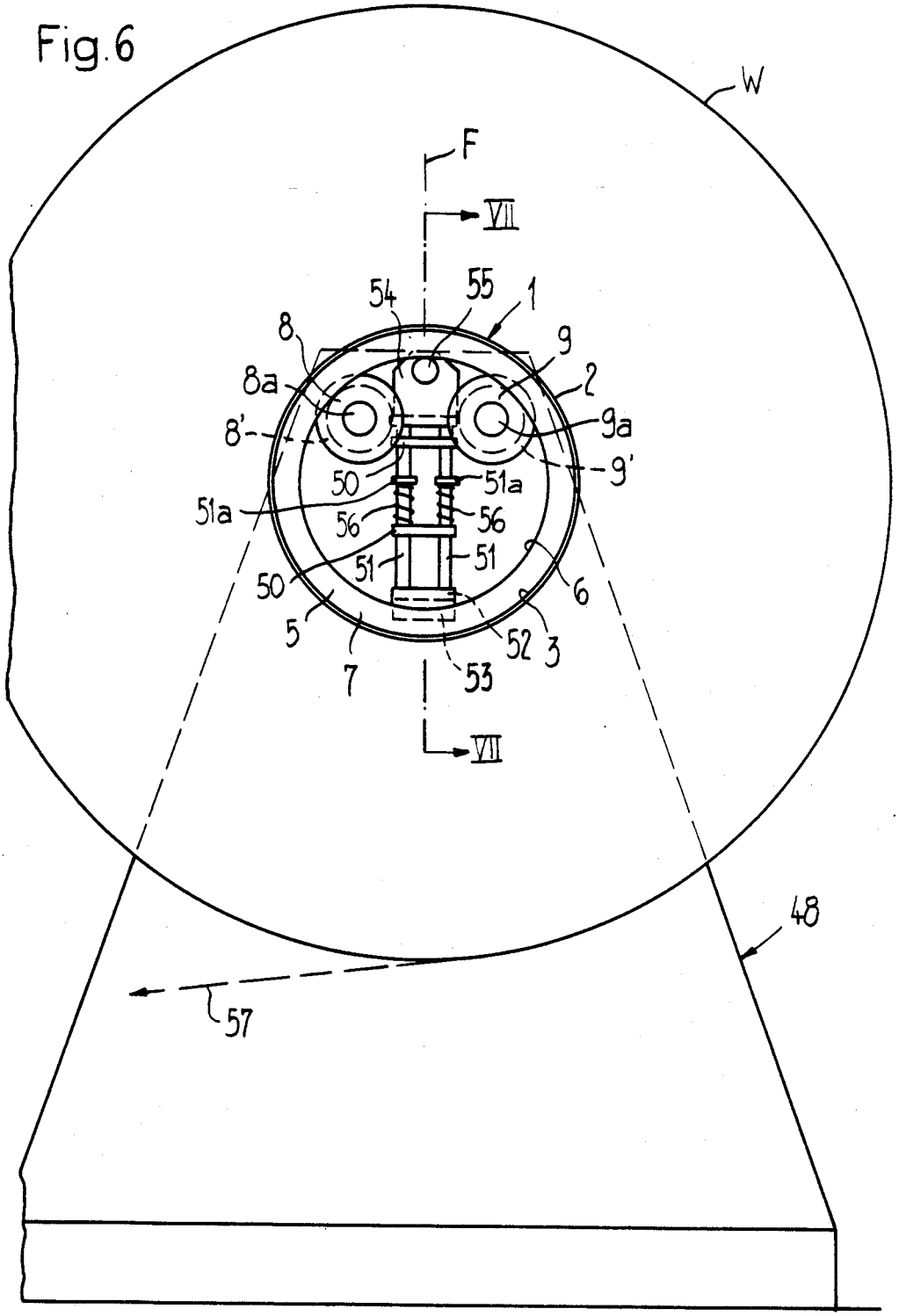
FIG. 6 schematically illustrates an unwinding station in frontal elevation.
Figure 7:
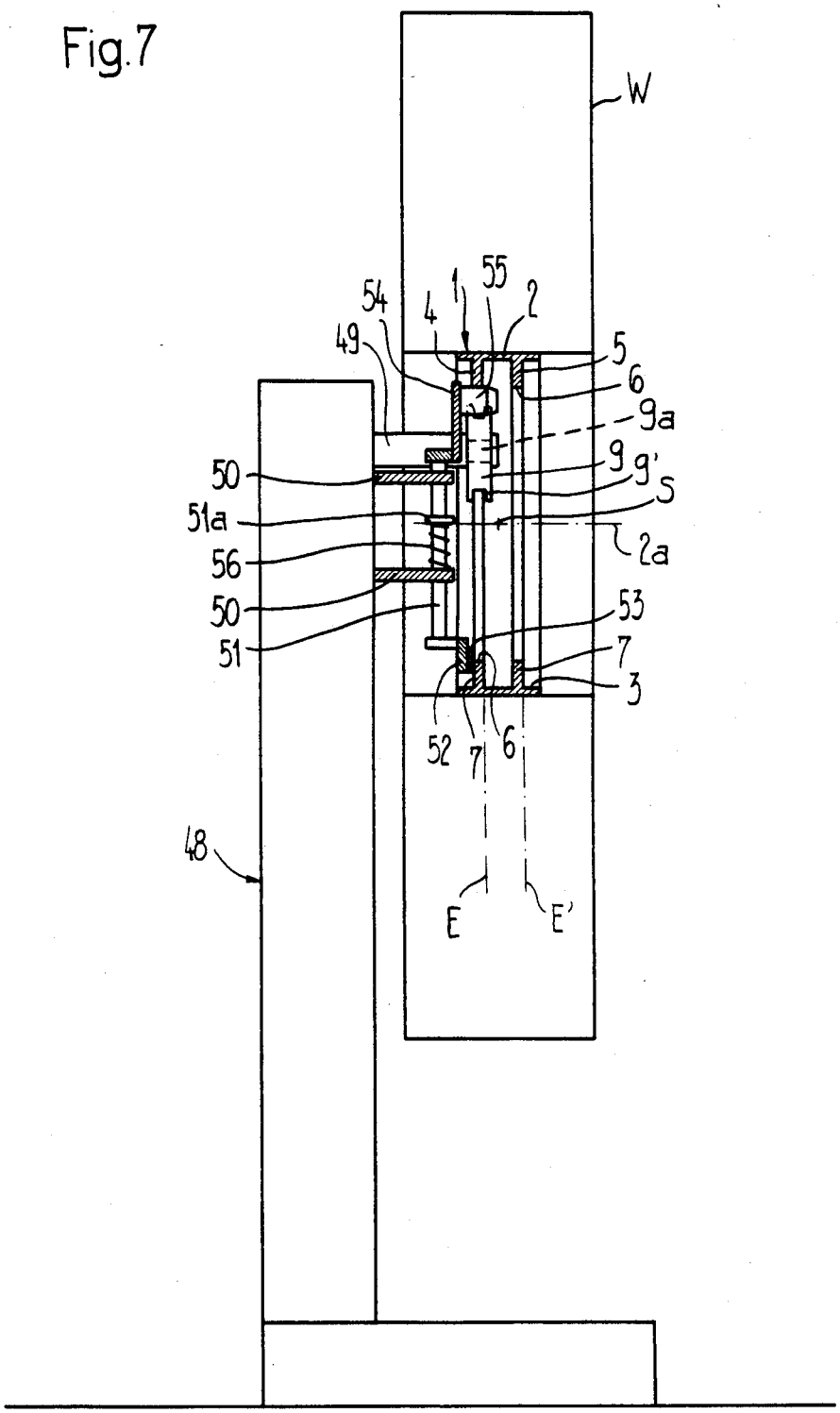
FIG. 7 schematically illustrates a section taken along the line VII—VII in FIG. 6.

For extracting the printed products from the storage coil or wound package W, the winding mandrel 1 together with the storage coil or wound package W is brought to an unwinding station such as is shown in FIGS. 6 and 7. This unwinding station comprises a base or stand 48 provided with bearings 49 for the shafts 8*a* and 9*a* of the support rolls 8 and 9 respectively. These support rolls 8 and 9, as in the previously described winding station, are arranged opposite one another in relation to a vertical plane F (cf. FIG. 6) and the axes of the shafts 8*a* and 9*a* extend substantially parallel to this vertical plane. The support wheels 8 and 9 are also provided with peripheral or circumferential grooves 8′ and 9′ in which the web 4 of the winding mandrel 1 engages and bears upon bearing surfaces 6 on the bottom of the peripheral grooves 8′ and 9′. Both support rolls 8 and 9 therefore form, just as do the support rolls 8 and 9 of the winding station, support means for the winding mandrel 1 and serve to support the winding mandrel 1 radially.

Two retaining plates 50 are fastened to the stand 48. Two vertically extending and mutually spaced pins 51 are retained in these retaining plates 50. These pins 51 carry a support plate 52 at their lower ends upon which a brake lining or pad 53 is mounted. This brake lining or pad 53 consists of a suitable material, preferably plastic, for instance the commercially available product VULKOLLAN. The web 4 of the winding mandrel 1 bears upon the brake lining or pad 53 with its outer support surface 7. The support plate 52 together with the brake lining or pad 53 serves, as does the support roll 31 of the winding station, to support the winding mandrel 1 in the direction of its longitudinal axis 2*a*.

The pins 51 carry a bracket plate 54 at their ends opposite the support plate 52. A pin 55 protrudes from the bracket plate 54 and extends so far forward from the bracket plate 54 that it can be engaged by the web 4 when the web 4 bears upon the support wheels 8 and 9. A compression spring 56 is arranged between one of the retainer plates 50 and an annular shoulder 51*a* of the pins 51. The pins 51 and therefore also the support plate 52, together with the brake lining or pad 53, are retained in the operative position shown in FIGS. 6 and 7 when the winding mandrel 1 is seated upon the support wheels 8 and 9. In this position the compression springs 56 are compressed. When the winding mandrel 1 is raised from its support means, the compression springs 56 cause an upward motion of the pins 51 together with the components 52, 53, 54 and 55 connected therewith.

The unwinding of the printed products from the storage coil or wound package W is effected in known manner by exerting tension on the winding band or strap 57 indicated in dotted line in FIG. 6, as is described in the previously mentioned German Patent Publication No. 3,123,888 and the corresponding British Patent Publication No. 2,081,230, both corresponding to the aforementioned U.S. patent application Ser. No. 06/432,557. In this unwinding procedure the winding mandrel 1 is set into rotation and a braking effect ensues due to the web 4 bearing against the brake lining or pad 53. Since, just as was previously described in relation to FIGS. 1 and 2, the bearing point of the winding mandrel 1 upon the support wheels 8 and 9 is disposed at a distance from the vertical plane F in which the center of gravity S of the winding mandrel 1, together with the storage coil or wound package W, is situated, an overturning or tipping moment acts upon the winding mandrel 1 and tends to press the winding mandrel 1, respectively the web 4, against the brake lining or pad 53, respectively against the support plate 52.

This overturning or tipping moment is greatest when the storage coil or wound package W is full and diminishes as the storage coil or wound package becomes smaller. Consequently, the force with which the web 4 is pressed against the brake lining or pad 53 also changes, which has the desired result that the braking effect diminishes in the course of the unwinding procedure.

The support plate 52 together with the brake lining or pad 53 serves, just as does the support roll 31 in the winding station, to axially support the winding mandrel 1 and to maintain the proper, i.e. vertical orientation of the winding mandrel 1. The support plate 52 with the brake liner or pad 53 performs the function of a brake. Therefore, a supplementary braking device can be renounced.

The coupling of the winding mandrel 1 with the storage coil or wound package W is basically effected in the same manner as was previously described in relation to FIGS. 1 and 2 by depositing the winding mandrel 1 with the web 4 upon the support wheels 8 and 9 by means of a transport device engaging the other web 5. As previously mentioned, the support plate 52, together with the brake lining or pad 53, is translated out of an idle position in which it does not interfere the deposition of the winding mandrel 1 into an operative position during this deposition. The removal of the empty winding mandrel 1 is effected in analogous manner.

It will be manifestly evident from the preceding description that the winding mandrel 1 according to the invention is simple in construction and can therefore be fabricated in economical manner. Furthermore, the empty winding mandrel 1 requires little space for storage. The manipulation of the winding mandrel 1 can be effected in simple manner independently of whether it is empty or loaded with a storage coil or wound package W. This manipulation and, in particular, the coupling to and uncoupling from the winding and unwinding stations is particularly simple when, as shown in the figures, two webs 4 and 5 are provided which are furthermore functionally equivalent to one another. This means that each web 4 or 5 is suited to be deposited upon the support wheels 8 and 9.

Since the webs 4 and 5 are arranged such that they are eccentric in relation to the center of gravity S of the winding mandrel 1 and also of the storage coil or wound package W in the direction of the longitudinal axis 2*a*, an overturning or tipping moment arises when one of the webs 4 and 5 is deposited upon the support means 8 and 9 which tends to bring the winding mandrel 1, together with the storage coil or wound package W, into a sloping or tilted orientation. Such a sloping or tilted orientation is prevented by the support roll 31 (cf. FIGS. 1 through 4), respectively by the support plate 52 together with the brake lining or pad 53 (cf. FIGS. 6 and 7). Nevertheless, the winding mandrel 1 is pressed against these support structures 31, respectively 52, 53, with a certain axial force which ensures that the winding mandrel 1 is guided during its rotation and is retained in its vertical position.

Little space is required for the intermediate storage of the full winding mandrels 1, especially when, as is shown in the figures, the winding mandrel 1 is not as wide as the storage coil or wound pachage W or, alternatively, has at most the same width, i.e. when the winding mandrel 1 does not protrude beyond the storage coil or wound package W. It will be understood that both the winding mandrel 1 as well as the winding and unwinding stations can be constructed in their various components differently than shown in the figures. Only a few of the possible different alternate embodiments will be described in more detail in the following.

It is of course conceivable to construct the winding mandrel 1 with only one web 4 and to omit the other web 5. Naturally, the advantages in manipulation which ensue from the presence of the second web 5 are then lost. If only one web is provided, then it can be arranged in a plane extending substantially perpendicular to the longitudinal axis 2*a* of the winding drum 2 and in which the center of gravity S of the winding mandrel 1 is also situated. In order to be able to exploit the advantages arising from the previously mentioned overturning or tipping moment in such an embodiment, the storage coil or wound package would have to be formed laterally eccentric to the winding mandrel 1 so that the center of gravity of the entity formed by the winding mandrel 1 and the storage coil or wound package W is ultimately eccentric in relation to the bearing points of the web.

Instead of the webs 4 and 5, support elements of other design could also be employed, such as annular grooves 100 and 101 arranged upon the interior 3 of the winding drum 2 and open toward the interior 3 of the winding drum 2. It will be understood that in such an embodiment the support wheels 8 and 9, and perhaps also the support structures 31, 52 and 53, would also have to be appropriately modified, for instance to have the form of the support wheels 102.

In the exemplary embodiments shown, the support facility, i.e. the support surface 7, which serves to axially support the winding mandrel 1 is formed by the same element which serves for radial support, namely the web 4, respectively 5. It is also possible to provide this support facility for axial support separately from the support element for radial support.

While there are shown and described present preferred embodiments of the invention, it is to be distinctly understood that the invention is not limited thereto, but may be otherwise variously embodied and practiced within the scope of the following claims. Accordingly,

What I claim is:

1. A winding mandrel for a coil formed from flexible, substantially flat products, especially printed products, said winding mandrel having a center of gravity and comprising:

a hollow substantially cylindrically annular winding drum;

said winding drum having an interior side, an unobstructed interior space, a longitudinal axis and an associated plane;

said plane extending essentially perpendicular to said longitudinal axis and lying outside said center of gravity;

said winding drum including:

at least one annular support member distinct from said interior side for axial support of the winding mandrel;

at least one annular support element distinct from said interior side for radial support of the winding mandrel; and said at least one annular support element extending along said interior side of said winding drum and being essentially arranged in said plane.

2. The winding mandrel as defined in claim 1, wherein:

said center of gravity is a property of said winding mandrel when empty.

3. The winding mandrel as defined in claim 1, wherein:

said center of gravity is a property of said winding mandrel when loaded with a wound coil.

4. The winding mandrel as defined in claim 1, wherein:

at least one of said annular support member and said annular support element comprises a circumferential web member protruding inwardly from said winding drum; and said circumferential web member having a radially extending annular configuration with an unobstructed interior opening.

5. The winding mandrel as defined in claim 1, wherein:

at least one circumferential web member protruding inwardly from said winding drum forms said at least one support member, and said at least one circumferential web member having an annular configuration with an unobstructed interior opening.

6. The winding mandrel as defined in claim 1, wherein:

at least one circumferential web member protruding inwardly from said winding drum forms said at least one support element; and said at least one circumferential web member having an annular configuration with an unobstructed interior opening.

7. The winding mandrel as defined in claim 1, wherein:

at least one of said support member or said support element comprises an annular groove open to said interior side of said winding drum.

8. The winding mandrel as defined in claim 1, wherein:

at least one annular groove open to said interior side of said winding drum forms said at least one annular support member.

9. The winding mandrel as defined in claim 1, wherein:

at least one annular groove open to said interior side of said winding drum forms said at least one annular support element.

10. The winding mandrel as defined in claim 1, further including:

two annular support elements arranged in mutual spaced relationship.

11. The winding mandrel as defined in claim 1, wherein:

each said at least one annular support element is provided with a bearing surface adapted to bear upon support wheels of a support apparatus.

12. The winding mandrel as defined in claim 1, wherein:

said at least one annular support element has an engagement surface adapted to engage with at least one driven friction drive wheel of a support apparatus.

13. The winding mandrel as defined in claim 1, wherein:

said at least one annular support element has a substantially cylindrical interior surface;

said interior surface being provided with radially inwardly projecting gear teeth defining an internal ring gear and which are capable of being brought into mesh with at least one driven gear of a support apparatus.

14. The winding mandrel as defined in claim 1, wherein:

said at least one annular support element is provided with at least one engagement means adapted to engage a drive element of a support apparatus.

15. The winding mandrel as defined in claim 14, wherein:

said at least one engagement means comprises an engagement bore.

16. The winding mandrel as defined in claim 1, wherein:

each said at least one annular support member comprises a support surface.

17. The winding mandrel as defined in claim 16, wherein:

said support surface is formed at said at least one annular support element.

18. The winding mandrel as defined in claim 16, wherein:

the at least one annular support member and said at least one annular support element are defined by the same component.

19. A winding mandrel for a coil formed from flexible, substantially flat products, especially printed products, said winding mandrel having a center of gravity and comprising:

a hollow substantially cylindrically annular winding drum;

said winding drum having an interior side, an unobstructed interior space, a longitudinal axis and an associated plane;

said plane extending essentially perpendicular to said longitudinal axis and lying outside said center of gravity;

said winding drum including means serving for axial support of the winding mandrel and for radial support of the winding mandrel; and said means extending along said interior side of said winding drum and being essentially arranged in said plane.

20. The combination of a winding mandrel for a coil formed from flexible, substantially flat products, especially printed products, and an apparatus for supporting said winding mandrel, wherein:

said winding mandrel comprises:

a hollow substantially cylindrically annular winding drum having an interior side, an unobstructed interior space, a longitudinal axis and an associated plane extending essentially perpendicular to said longitudinal axis and lying outside a center of gravity of said winding mandrel;

at least one annular support member distinct from said interior side for axial support of the winding mandrel; and at least one annular support element distinct from said interior side for radial support of said winding mandrel and being substantially arranged in said plane and extending along said interior side;

said supporting apparatus comprising:

support means for cooperating with said at least one annular support element of said winding drum for radially removably supporting said winding mandrel at a location lying outside said center of gravity of said winding mandrel; and a support structure for cooperating with said at least one annular support member of said winding drum for axially removably supporting said winding mandrel.

21. The combination as defined in claim 20, wherein:

said associated plane is a substantially vertical plane;

said support means comprising two rotatably journalled support wheels having axes of rotation;

said support wheels lying opposite one another with respect to said vertical plane; and said axes of rotation of said support wheels extending essentially parallel to said vertical plane.

22. The combination as defined in claim 21, wherein:

means for driving said support wheels;

said support wheels being constructed as friction drive wheels; and said support wheels being capable of being brought into tractive contact with said at least one annular support element of said winding drum.

23. The combination as defined in claim 21, wherein:

means for driving said support wheels;

said support wheels being provided with gearing capable of being brought into mesh with the gear teeth provided on said at least one annular support element of said winding drum.

24. The combination as defined in claim 20, wherein:

said support structure comprises at least one support facility; and said at least one annular support member of said winding drum bearing upon said support facility when said winding mandrel is supported in said support means.

25. The combination as defined in claim 24, wherein:

said at least one support facility is arranged beneath said support means.

26. The combination as defined in claim 24, further including:

a spring; and said support facility being translatable toward said support means against the action said spring.

27. The combination as defined in claim 24, wherein:

said support facility is constructed as a rotatably journalled roll;

said at least one annular support member having a support surface; and said roll cooperating with said support surface of said support member.

28. The combination as defined in claim 24, wherein:

said support facility comprises a brake pad;

said at least one annular support member has a braking surface; and said brake pad being capable of being brought into contact with said braking surface of said at least one annular support member.

29. The combination as defined in claim 24, further including:

a driven rotary entrainment device releasably connectable with said winding mandrel.

30. The combination as defined in claim 29, wherein:

said entrainment device comprises at least one coupling lever; and said at least one coupling lever being capable of being brought into releasable engagement with said at least one annular support element of said winding drum.

* * * * *